United States Patent [19]

Lee

[11] 4,088,454

[45] May 9, 1978

[54] METHOD FOR PRODUCING A LIQUID FUEL COMPOSITION

[75] Inventor: Soo B. Lee, Seoul, South Korea

[73] Assignee: Ki Hyun Lee, Los Angeles, Calif.

[21] Appl. No.: 735,675

[22] Filed: Oct. 26, 1976

[51] Int. Cl.[2] ..... C10L 1/16; C10L 1/18

[52] U.S. Cl. ..... 44/51; 44/56

[58] Field of Search ..... 44/50, 51, 53, 56; 208/370

[56] References Cited

U.S. PATENT DOCUMENTS

| | | | |
|---|---|---|---|
| 1,431,225 | 10/1922 | Greenstreet | 44/51 |
| 1,432,178 | 10/1922 | Greenstreet | 44/51 |
| 1,684,685 | 9/1928 | Records | 44/53 |
| 2,764,553 | 9/1956 | Hartford | 44/53 X |
| 2,995,427 | 8/1961 | Sigworth et al. | 44/53 |

OTHER PUBLICATIONS

Shreve, *Chemical Process Industries*, p. 559, 3rd ed., McGraw-Hill (1945).

*Primary Examiner*—Daniel E. Wyman
*Assistant Examiner*—Thomas A. Waltz
*Attorney, Agent, or Firm*—Poms, Smith, Lande & Glenny

[57] ABSTRACT

A method for making a fuel which comprises adding to an oxidation resistant tank from 80% to 60%, by volume, of an aqueous solution of potassium hydroxide, sodium hydroxide, or sodium bicarbonate, and also adding a lower alkyl alcohol to said tank and transferring a prefuel composition (as defined herein) from a separate container to said tank so that said prefuel composition mixes with said lower alkyl alcohol and aqueous solution and continuing to add said prefuel composition to said tank until the tank overflows, and recovering the thus obtained liquid fuel composition which has overflowed from the top of the tank.

2 Claims, No Drawings

METHOD FOR PRODUCING A LIQUID FUEL COMPOSITION

BACKGROUND OF THE INVENTION

As is known, in the past few years, the population of the world has increased greatly, and is now approaching from three to four billion people. In the meantime, the energy necessary for supporting this number of people, particularly in view of the demands of the people, has increased even more rapidly than the number of people and the availability of such energy (particularly fossil fuel) is decreasing just as rapidly. Therefore, society is now attempting to obtain fossil fuel from sources which were heretofore considered uneconomical. For example, drilling arctic wasteland and under the sea is now taking place in an attempt to produce a sufficient amount of fossil fuel to support this vastly increased population of the world. In addition to attempting to obtain fossil fuel in heretofore undesirable locations, it has also been suggested to utilize fossil fuel, such as petroleum oil, with, for example, water. This, in theory, would extend the amount of petroleum oil available, depending upon the amount of water which could be mixed with the oil and still give a usable fuel. However, water is not mixable with oil or gasoline, and therefore, it is difficult to form homogeneous mixtures thereof, but, more importantly, if relatively large amounts of water are mixed with the oil, the energy produced by the oil is reduced proportionately.

SUMMARY OF THE INVENTION

The present invention relates to a process for producing a liquid fuel composition, which, when mixed with alcohol and water, will produce a one-phase admixture which is useful for producing energy by burning said one-phase admixture to, for example, produce steam to generate electricity and the like. Additionally, such a fuel composition can be used in internal combustion engines.

The liquid fuel composition of the present invention is made by first producing what I call in this application, a "precursor fuel". This precursor fuel is called a prefuel composition in my co-pending United States Application Ser. No. 654,015, filed Jan. 30, 1976, and entitled "PREFUEL COMPOSITION AND METHOD". As described in the co-pending application, such description being incorporated herein by reference, the precursor fuel is made, in general, as follows: oil, having a specific gravity of less than 1, water, and carbon are placed in a heating zone open to the atmosphere. The two liquids, i.e., the oil and water, form two phases, with the oil lying on top of the water. The carbon, which is preferably coke, is placed so that it contacts both the oil and water phase and is, in general, placed and present in such amounts that it is uniformly mixed through the two phases. The non-homogeneous mixture is then heated to such a temperature that the water vaporizes (e.g. from 50° C or 70° C. to 100° C.). The vaporized water bubbles through the oil as well as contacting the carbon. This heating continues for a period of time in the heating zone, which is open to the atmosphere to allow the vaporized water and any other vapors produced by the heating, to leave the heating zone and enter the ambient atmosphere. The heating is continued until substantially all of the water is removed and there remains a one-phase liquid and the solid carbon. The heating, at this point, is then discontinued and there is then mixed with the remaining liquid and carbon a light oil such as kerosene or the like. The liquid mixture is then separated from the solid and is then ignited in another vessel open to the atmosphere. After a period of time, the flame is extinguished by closing the opening to the atmosphere thereby depriving the combustion reaction of oxygen. The liquid remaining from such periodic ignition and extinguishment is the precursor fuel. Such a liquid, hereinafter for brevity, will be referred to as the precursor fuel.

As set out in the co-pending application, such a precursor fuel can be used to form a prefuel composition by mixing from 10% to 50%, by weight, of the precursor fuel with from 20% to 70%, by weight, of oil, and from 10% to 50%, by weight, of water to form a homogeneous admixture, which, for brevity's sake, will be hereinafter referred to as the "prefuel composition".

The precursor fuel composition itself, produces about ten thousand British Thermal Units (BTU) per pound. When this precursor fuel composition is mixed with a fuel oil (having a BTU content of about twenty thousand BTUs per pound) and water to form a prefuel composition, it was found that a one-phase solution resulted which can be burned. For example, a prefuel liquid composition composed of 40%, by weight, of fuel oil, 30%, by weight, of precursor fuel, and 30%, by weight, of water produced approximately 9,394 BTUs per pound. It would be expected that such a mixture would only give 11,000 BTUs per pound since water has a zero value, the precursor would have approximately 3,000 BTUs (i.e., one-third of a pound), and the fuel oil would have approximately 8,000 BTUs (i.e., 4 pounds). As is apparent, the prefuel composition results in a high saving of fossil fuel since it produces more BTUs per pound of fossil fuel than fossil fuel per se does.

The liquid fuel composition of the present invention produces even more BTUs per pound of fossil fuel contained therein than does the prefuel composition described in my co-pending application, and can be burned to form steam, which in turn, generates electricity. In short, the fuel composition made by the method of the present invention can be used to produce energy by burning in any convenient manner.

DESCRIPTION OF THE PREFERRED EMBODIMENT

In the present invention, the prefuel composition is mixed with a lower alkyl alcohol and an aqueous solution of potassium hydroxide, sodium hydroxide, and/or sodium bicarbonate. The sodium bicarbonate, potassium hydroxide, and/or sodium hydroxide is dissolved in water in an amount sufficient to produce an aqueous solution having a hydrometer reading, in degrees baume, of from 20 to 30 at 20°/4° C. Such an aqueous solution is mixed with the lower alkyl alcohol (preferably methyl or ethyl alcohol), such that the resulting aqueous solution-alcohol mixture is composed of from approximately 85% to 60% aqueous solution and from 40% to 15% lower alkyl alcohol, such percentages being by volume.

Such alcohol-aqueous solution mixture is placed in an alkali-oxidation resistant tank (stainless steel) and the amount of alcohol-aqueous solution added to such a tank (which is open at the top) is such that said alcohol-aqueous solution will fill 60% to 80% of the volume of the tank. After the filling of the alkali-oxidation resistant tank in the manner indicated, the prefuel composition is added to the tank containing the alcohol-aqueous solution in such a manner that the prefuel composition will mix with the alcohol-aqueous solution contained in the tank. The prefuel composition is added until the complete volume of the tank is filled at which time the prefuel composition will compose from 40% to 20% of the volume of the tank, and the alcohol-aqueous solution will be present in the tank in an amount of from 60% to 80% by volume. Preferably, the mixing and filling of the tank with the prefuel composition will take at least one hour or more, for example, three hours. The maximum length of time is not critical providing, as noted, that such mixing takes place at least for a length of time equal to one hour.

After the tank is full of prefuel composition and the alcohol-aqueous solution, more prefuel composition is added such that is also mixes with the alcohol-aqueous solution. Such mixing is preferably accomplished by having a hollow tube or pipe running from the container containing the prefuel composition to the tank, the end of the tube or pipe extending at least a third of the way down into the tank from the top, or even further, so that when the prefuel composition is added, it will mix with the alcohol-aqueous solution. There are, of course, other ways to also accomplish the mixing action which will be apparent to those skilled in the art and will not be enumerated in detail in this application.

In any event, after a sufficient amount of prefuel composition is added to the tank to fill it, more prefuel composition is added so that the tank overflows. The liquid which overflows is the fuel composition of the present invention. Preferably, the fuel composition is recovered by having a second, outer tank around the alkali-oxidation resistant tank, and the fuel composition can be retrieved from said outer tank by merely having a faucet, or the like at the bottom of said outer tank.

It should be noted that after the tank is full, the addition of the prefuel composition takes place at the same rate as the initial mixing did. That is, the prefuel composition is added slowly so that it takes at least one hour to add another 20% to 40%, by volume, of said prefuel composition. The maximum amount of fuel composition which can be recovered, and which is useful in the present invention, varies a great deal, but, in general, such mixing and overflowing can occur until a volume of fuel composition is obtained which is at least equal to the volume of the tank, and often times, more than twice the volume of the tank.

As noted in my co-pending application referred to above, a precursor fuel is made by mixing 40% water, 30% coke, and 30% oil in a cylindrical steel container in which the water is on the bottom and a layer of Bunker C. oil lays on top of the water, the solid coke being in contact with both the water and the Bunker C. oil. This non-homogenous mixture is then heated, at the bottom, to a temperature of between 70° C. and 100° C. and preferably, about 90° C., whereby the water vaporizes and bubbles through the Bunker C. oil and mixes with the Bunker C. oil and also the coke. In order to allow the vapors to escape, the cylindrical steel tank is open to the atmosphere and during the heating, the water and oil expand and heating is continued until substantially all of the water is removed. The length of heating is not particularly critical, but is conducted until substantially all of the water is vaporized and has bubbled through the Bunker C. oil.

In the preferred exemplary embodiment in my co-pending application, heating is discontinued after the water has been substantially vaporized and then a light oil, such as kerosene, is mixed with the liquid remaining, the amount of kerosene added being anywhere from 20%, by weight, to as high as 60%, by weight, the preferred amount being approximately 30% to 50%, by weight, based on the weight of the light oil and the composition remaining in the heating zone.

After such mixing, the liquid is removed from the bottom of the tank by a faucet or the like and such liquid is transferred to another steel container having an opening at the top which is provided with a cover, which when in place, provides an air-tight container.

After the liquid composition has been placed in the steel cylindrical container, the composition is ignited in any convenient manner and allowed to burn for a period of time from anywhere from one-tenth of a minute, upwards to 2 minutes and longer. The cover is then put on the container, making the container air-tight thus extinguishing the flame. The same procedure is then repeated, at least once, and up to as many as ten times or more. The resulting liquid is then removed. The liquid is a precursor fuel composition which has been mentioned heretofore.

In the present invention, such precursor fuel is mixed with from 10% to 50%, by weight, of water, and 20% to 70%, by weight, of oil, so that the entire prefuel composition contains from 10% to 50%, by weight of the precursor fuel, from 20% to 70%, by weight, of oil, and from 10% to 50%, by weight, of water.

As noted before, such prefuel composition is mixed with the alcohol-aqueous solution to form a fuel composition in accordance with the present invention which can be burned and produced a high amount of BTUs per pound, thereby to generate electricity and the like, said fuel composition producing more BTUs per pound than what would be expected from the amount of fossil fuel contained in said fuel composition.

I claim:

1. A method for producing a liquid fuel composition which comprises:

(a) adding to a container, from 10% to 50% by weight, of a precursor fuel, 20% to 70%, by weight, of oil and from 10% to 50%, by weight, of water to form a prefuel homogeneous liquid admixture in said container, said precursor fuel being made by placing carbon, water and oil, the oil having a specific gravity of less than one, into a heating zone having an opening to the atmosphere and forming a non-homogeneous mixture composed of a liquid phase of water and, on top thereof, a liquid of oil with coke intermixed in both liquid phases;

heating said non-homogeneous mixture to a temperature of from 50° C. to 100° C. to vaporize the water and bubble the water vapor through, and in intimate contact with, the oil;

discontinuing heating and adding from 20% to 60%, by weight, light oil to the remaining liquid in said non-homogeneous mixture to form a homogeneous mixture of the liquid oil and the liquid remaining in said non-homogeneous mixture and separating said uniform mixture of liquids from the solid carbon;

burning said uniform mixture of liquids in the presence of oxygen and extinguishing same by removing the source of oxygen, said burning and extinguishing steps being conducted between 1 and ten times and each burning step being conducted from about one-tenth of a minute to 2 minutes, and receiving the resulting liquid precursor fuel;

(b) adding to an alkali and oxidation resistant tank from 85% to 60%, by volume, of an aqueous solution of potassium hydroxide, or sodium hydroxide, or sodium bicarbonate, or mixtures thereof, said aqueous solution having a hydrometer reading, in degrees baume, of from 20 to 30 at 20°/4° C., and also adding from 40% to 15%, by weight, of lower alkyl alcohol, said aqueous solution and lower alkyl alcohol being added to said alkali and oxidation resistant tank in an amount such that, from 40% to 80% of the volume of the tank is filled with said lower alkyl alcohol and aqueous solution;

(c) transferring said prefuel homogeneous liquid admixture from said container to said tank so that said prefuel homogeneous liquid admixture mixes with said lower alkyl alcohol and aqueous solution, and continuing to add said prefuel homogeneous liquid admixture to said tank until the top of the tank overflows, said prefuel homogeneous liquid admixture being added to said tank at a rate which requires at least 1 hour to fill said tank, the amount of prefuel homogeneous liquid admixture being added at said rate being not in excess of twice the volume of said tank; and (d) recovering the thus obtained liquid fuel composition which has overflowed from the top of said tank.

2. A method according to claim 1 wherein the lower alkyl alcohol is a member selected from the group consisting of methyl and ethyl alcohol.

* * * * *